United States Patent [19]

Traut

[11] 4,008,982

[45] Feb. 22, 1977

[54] ROTARY FLUID ENERGY CONVERTER

[76] Inventor: Earl W. Traut, 8040 Palm Lake Drive, Orlando, Fla. 32811

[22] Filed: Apr. 28, 1975

[21] Appl. No.: 572,384

[52] U.S. Cl. ..... 417/204; 418/24; 418/28; 418/60; 418/61 B; 60/484; 60/486; 60/491

[51] Int. Cl.[2] ..... F04B 23/10; F01C 1/02; F01C 21/16; F16D 31/00

[58] Field of Search ..... 418/24, 28, 54, 58, 418/60, 61 B; 417/204; 60/484, 486, 491

[56] References Cited

UNITED STATES PATENTS

| | | | |
|---|---|---|---|
| 302,179 | 7/1884 | Walker | 418/54 |
| 1,277,018 | 8/1918 | Wolfington | 418/61 B |
| 2,162,771 | 6/1939 | Winans | 418/61 B |
| 3,285,189 | 11/1966 | Doyer | 418/61 B |
| 3,922,120 | 11/1975 | McCullough et al. | 418/61 B |

*Primary Examiner*—John J. Vrablik

[57] ABSTRACT

A mechanism with only two dynamic components, in which rotating crank motion is converted to intermittent rotation of an elongate rotor within a generally triangular chamber and vice versa. When the rotor and chamber are enclosed, the mechanism becomes a positive displacement fluid pump or motor capable of converting rotational torque into fluid pressure and vice versa; a high volume of fluid moving through a small device at comparatively low shaft speed. Further modification of the mechanism permits the rotor to slide axially while rotating, resulting in a variable displacement rotary fluid pump or motor. Adaptations of the invention provide: shaft drives having continuously variable speed ratios; fluid energy transformers wherein flow and pressure may be continuously converted into variably different flow and pressure; and continuously variable, gearless automotive transmissions. Additional capabilities include efficient pneumatic motors, compressors, and external combustion engines.

8 Claims, 13 Drawing Figures

10
11
12
13
13a
13b
13c
14
15
15a
15b
15c
15d
15e
15f
16
17
18
19
19a
20
21
22
2

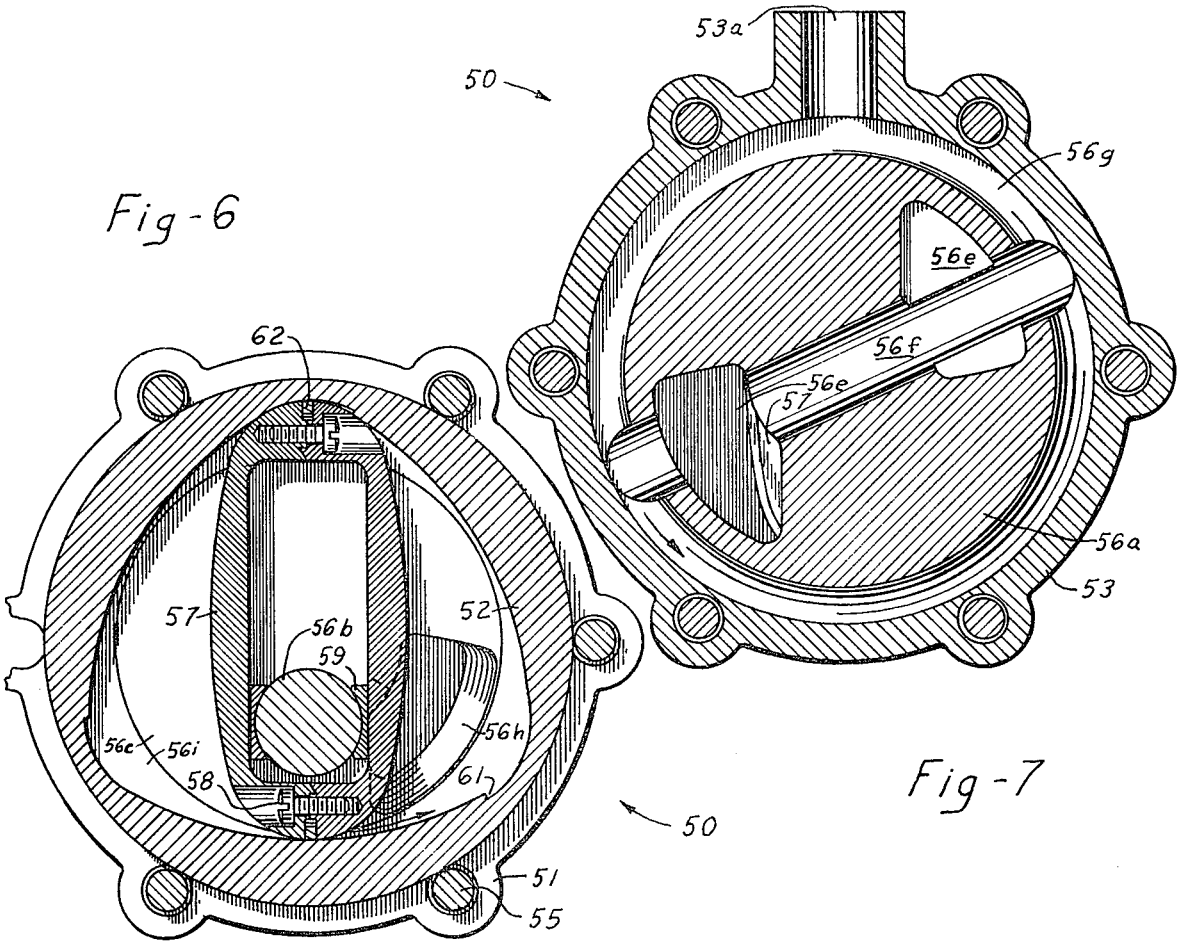
Fig-6
Fig-7
50
53a
56g
56e
56f
56e
57
56a
53
62
57
56b
59
52
56h
56c
56i
58
61
50
51
55
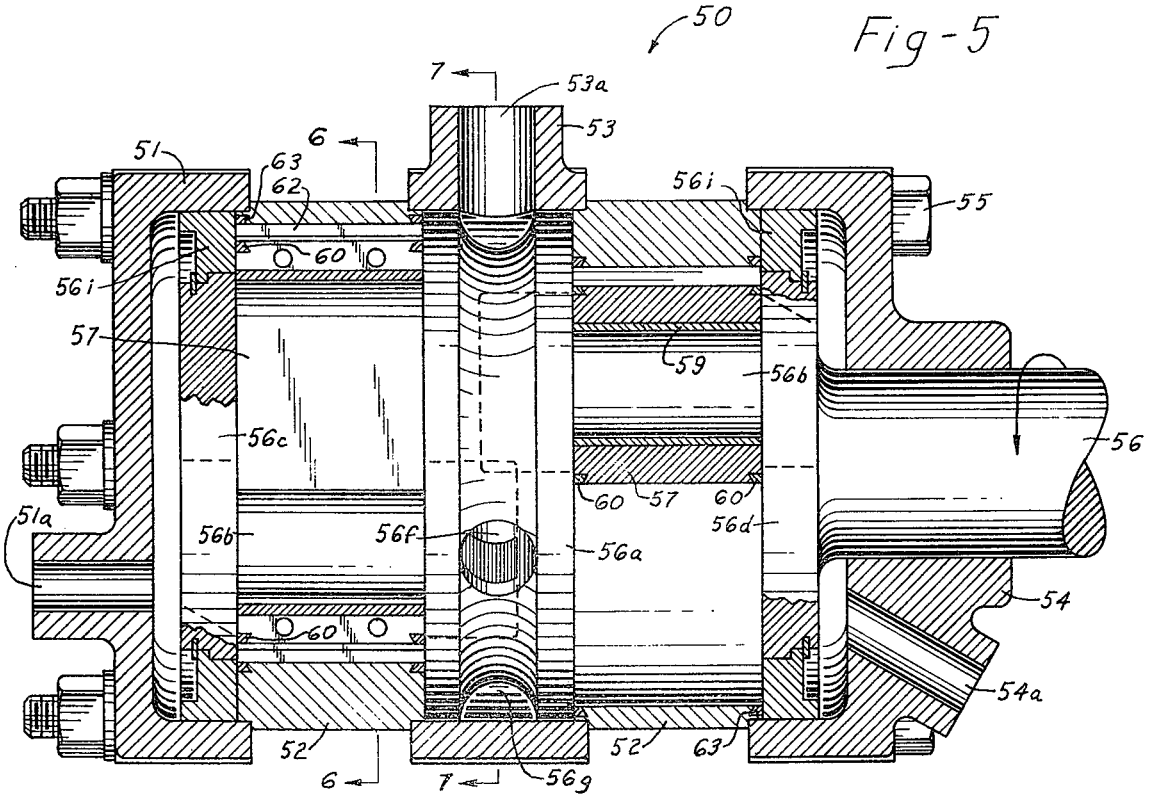
Fig-5
50
7
53a
53
6
51
63
62
56i
55
60
56i
57
59
56b
56c
56
60
57
60
51a
56b
56f
56d
56a
54
60
54a
52
52
63
6
7
56g Fig-8
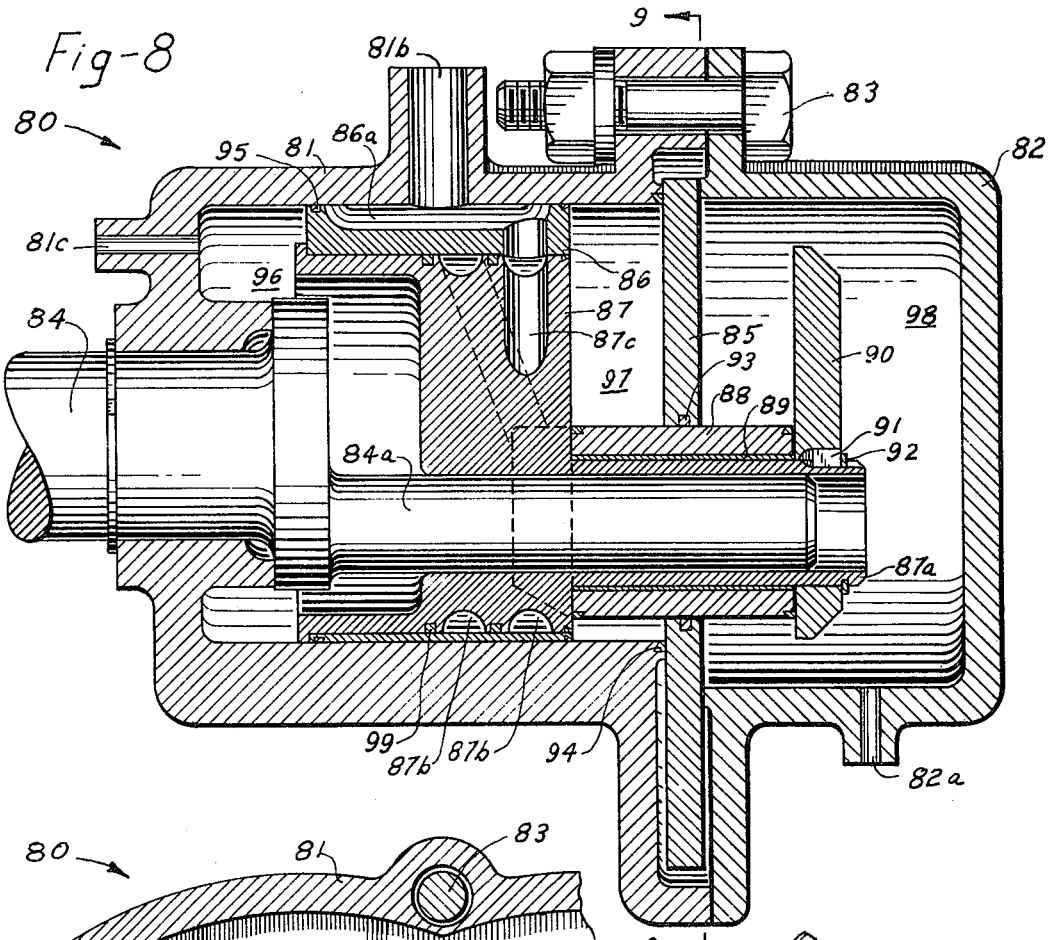
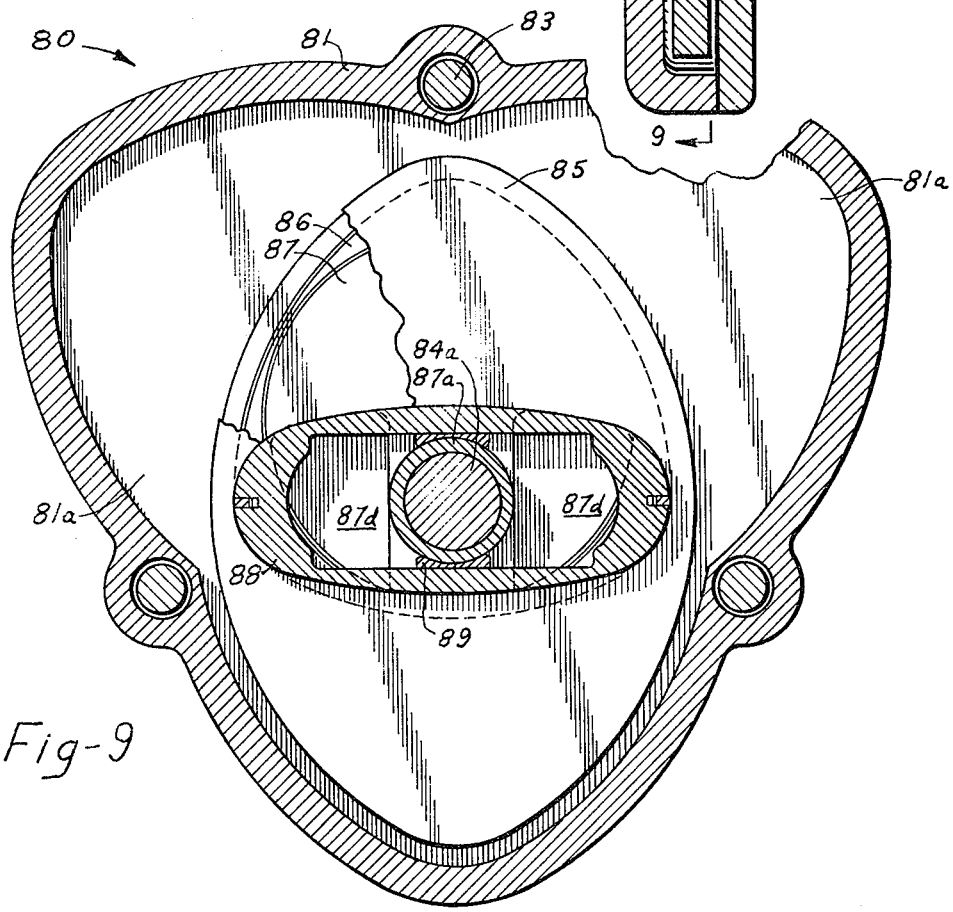
Fig-9

ROTARY FLUID ENERGY CONVERTER

BACKGRUND OF THE INVENTION

Typical rotary fluid energy converters, such as pumps and fluid motors, are often bulky or complex and depend on high speed operation to accommodate a high rate of liquid flow, also usually being impractical for energy conversion between gases and rotary mechanisms. Existing variable displacement pumps and motors usually possess these disadvantages to a greater degree.

SUMMARY OF THE INVENTION

The invention provides a mechanism in which a crank operating within a slot in an elongate rotor causes this rotor to pivot alternately around its ends within a generally triangular chamber; that is, rotate end over end; the ends of this elongate rotor always being in contact with corners or sides of the chamber.

When the chamber and rotor are enclosed by end plates, the rotor serves to divide the chamber into two compartments whose volume changes with rotation of the rotor. One of the end plates is modified to accept the shaft and includes a recess for a disk, the disk facing the chamber and being coaxially part of the shaft. Extension of the crank into the rotor slot serves to divide the slot into two cells whose volume changes with movement of the crank within the slot. These changes in volume of the chamber compartments and rotor slot cells are used for movement of fluid, thereby occasioning energy conversion between fluid pressure and rotary torgue.

The disk includes two ports, each in communication with an external opening in the rotary fluid energy converter (RFEC), so that fluid may be conducted therethrough to and from the compartments and cells. These two ports are located in the disk where they: never communicate with each other; each communicate with a rotor slot cell but not with a chamber compartment when both ends of the rotor are in corners of the chamber; each communicate with a chamber compartment but not with a rotor slot cell when one rotor end is in a corner and the other rotor end is midway between the other two corners; each communicate with both a chamber compartment and a rotor slot cell in intermediate rotor positions.

The intermittent starting and stopping of the rotor causes the rate of fluid flow to fluctuate. This fluctuation can be minimized by utilizing two rotor and chamber sets which operate in parallel and out of phase with each other; so that as one is at minimum fluid flow the other is at maximum flow, resulting in a combined fluid flow which is fairly uniform. Another means of minimizing this fluctuation requires only one chamber and rotor; the rotor and crank being very broad, so that the active volume of the slot approximates the active volume of the chamber.

A rotary fluid energy converter (RFEC) whose displacement per revolution is variable, may be obtained by inserting an axially movable triangular ring around the circumference of the disk at one end of the rotor and by additionally placing a movable plate at the end of the chamber opposite the disk; the plate having an internal hole shaped as the rotor cross section, through which the other end of the rotor may slide. As the rotor, disk and triangular ring slide axially within the chamber, the distance between the disk and the plate changes, causing a variation in the chamber displacement per revolution.

Two variable displacement RFEC's may be joined together so that their shafts project from the ends of the combination and so that their sliding assemblies are fastened through a thrust bearing which permits them to rotate independently but requires them to slide together axially. Torgue applied to one shaft causes its rotor to operate as a pump, the fluid output of which drives the other rotor and shaft in rotaton at an angular velocity dependent upon the axial position of the sliding assemblies, thus providing a shafted device which possesses a wide range of continuously variable speeds.

If two variable displacement RFEC's are joined together so that their cranks have a common shaft and so that all of their sliding components operate in triangular chambers, a device results which has two separate steady-flow variable displacement pumps or motors. These RFEC's may work together in various ways to provide useful devices such as: a continuous liquid energy transformer which includes no shaft, mechanisms whose speed varies with applied load, a solar energy converter which can automatically adapt to variations in the quantity of heated fluid flow to provide torgue output at a constant shaft speed and simultaneously pump spent fluids back for reheating, a gearless automotive automatic transmission, and a variable displacement external combustion engine.

Accordingly, it is an object of the present invention to provide a mechanism wich includes only two rotating components, in which rotation of a shaft with crank may be interchanged with intermittent rotation of an elongate rotor.

Another onject of the invention is to use this mechanism as a simple rotary fluid energy converter.

A further object of the invention is to provide a rotary fluid energy converter which may be operated either as a fluid pump or a fluid motor.

A yet further object of the invention is to provide a rotary fluid energy converter which efficiently uses the space it occupies to move a large volume of fluid per rotation of its elements.

Yet another object of the invention is to provide a rotary fluid energy converter which has a positive, yet variable displacement.

Still another object of the invention is to mechanically combine rotary fluid energy converters to provide simple variable fluid to fluid energy transformers, automotive transmissions, and other fluid operated devices.

Other objects of this invention will appear from the following description and appended claims, reference being had to the accompanying drawings forming a part of this specification wherein like reference characters designate corresponding parts in the several views.

FIG. 5 is a vertical sectional view of a rotary fluid energy converter similar to FIG. 1 but in which two out-of-phase rotors are employed.

FIG. 6 is a sectional view taken along line 6—6 of FIG. 5 and looking to the left to show details of the rotor and porting arrangements.

FIG. 7 is a sectional view taken along line 7—7 of FIG. 5 and looking to the left to reveal ducting and porting in the central disk.

FIG. 8 is a vertical sectional view of a variable displacement rotary fluid energy converter in accordance with another embodiment of the invention.

FIG. 9 is a sectional view taken along line 9—9 of FIG. 8 and looking to the left to reveal details of the central plate.

DETAILED DESCRIPTION

Figures 1, 2, 3, 4:
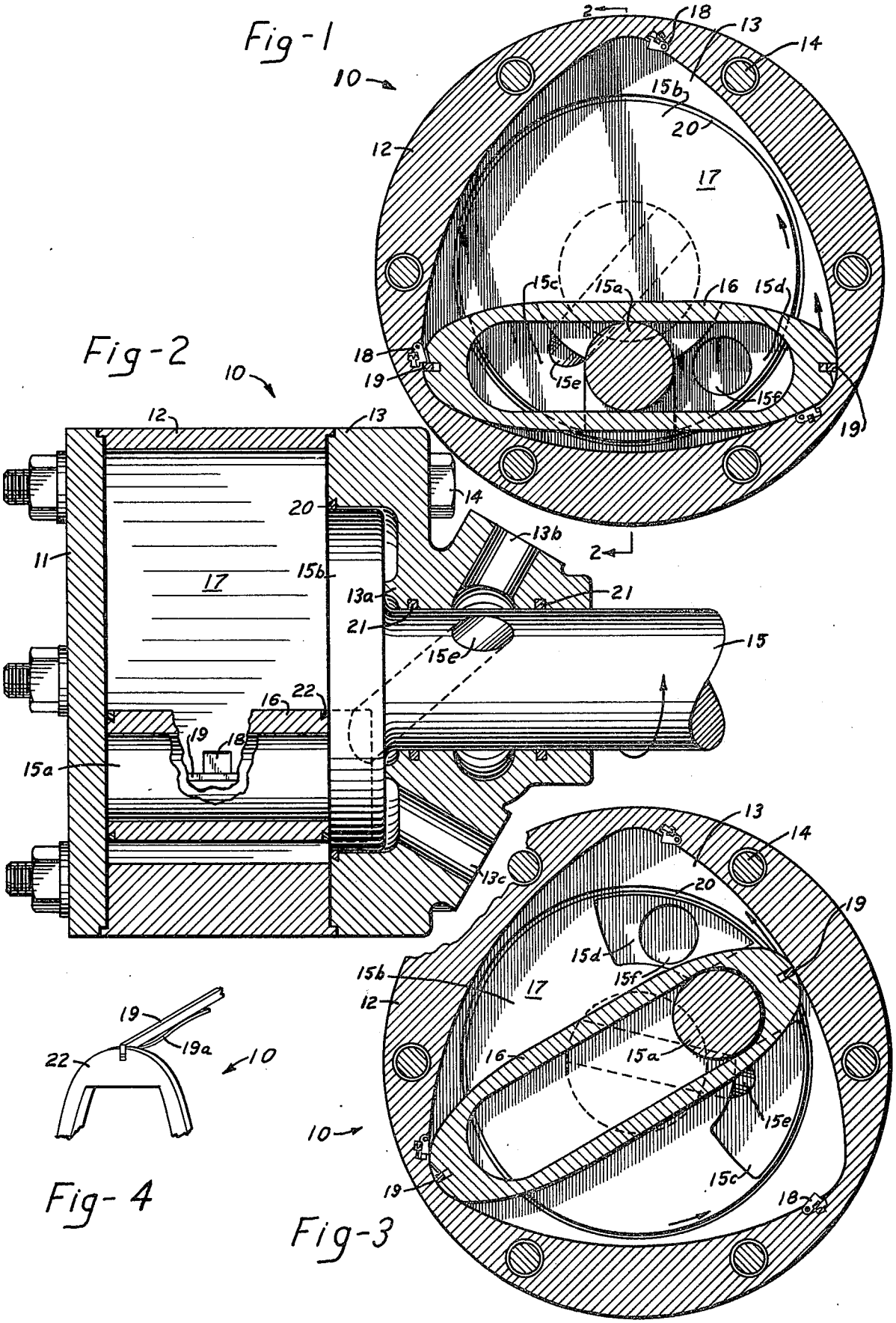
FIG. 1 is a vertical sectional view of a rotary mechanism in which rotary crank motion is converted into intermittent rotary motion of an elongate rotor in accordance wth one embodiment of the invention.
FIG. 2 is a sectional view taken along line 2—2 of FIG. 1 and looking to the left show the longitudinal arrangement of the components.
FIG. 3 is another sectional view similar to FIG. 1, after 30° of rotor rotation and 120° of crank rotaton.
FIG. 4 is a fragmentary perspective view of the rotor seals used in the mechamism of FIG. 1 to reveal their shape and relationship.

Turning now to FIGS. 1 and 2 there will be seen mechanism 10 which includes two dynamic components; continuous rotation of a crank producing intermittent rotation of an elongate slotted rotor. Mechanism 10 is reversible; that is, intermittent rotation of the rotor may be used to produce rotation of the crank. The rotor may rotate in either direction. Also, crank and rotor may rotate either in the same or in opposite directions with respect to each other.

In FIGS. 1 and 2, shaft 15 rotates within and is supported by stationary end housing 13, bearings being addible therebetween if desired. End housings 11 and 13 are fastened to the ends of chamber housing 12 by bolts 14 and their associated nuts and washers. End housing 11 is not essential to mechanism 10; other means of retaining rotor 16 and shaft 15 in position being possible, such as retainig rings. Crank 15*a* is integral with, parallel to, and radially displaced from the axis of shaft 15. In FIG. 1 it can be seen that rotor 16 is symmetrically elongate and has rounded ends. Rotor 16 also includes a central longitudinally oriented slot into which crank 15*a* extends; crank 15*a* being free to move back and forth in this slot.

Chamber 17 comprises a space within housing 12 which is generally triangular in cross section. Chamber 17 is coaxial with shaft 15 and has small-radius corners interposed by large-radius arcuate sides. Note that the cross sectional shape of chamber 17 is determined by the length of rotor 16 and the radius of its ends. That is, each corner of chamber 17 has the same radius as either end of rotor 16, and the radius of each arcuate side of chamber 17 is equal to the overall length of rotor 16 minus the radius of one end; this relationship assuring that the radius described by the free end of rotor 16, as its other end pivots in a corner, corresponds to the radius of the arcuate sides of chamber 17. Note that the radius of the ends of rotor 16 could be considerable larger or smaller.

In FIG. 1, note that the left end of rotor 16 cannot depart the left corner of chamber 17 because it is blocked by latch 18. Thus the left end of rotor 16 acts as a pivot while its right end is free to depart the right corner and move along the right arcuate side of chamber 17, maintaining contact therewith until it arrives in the upper corner of chamber 17 after 60° of counterclockwise rotation. As the right end of rotor 16 arrives in upper corner it passes another latch 18 which prevents it from subsequently reversing direction. Thus rotor 16 rotates intermittently end over end in only one direction inside triangular chamber 17, while crank 15*a* slides back and forth in the slot of rotor 16 as it rotates with shaft 15.

The three latches 18 have hinge pins extending through them and into housing 12 to hold them in position, and they are spring-loaded so that they will tend to extend into chamber 17. As will be discussed later in connection with FIG. 6, recesses in the corners of the triangular chamber may also be used to preclude reverse movement of rotor 16.

In FIGS. 1 and 2, shaft 15 with crank 15*a* may rotate either 120° clockwise or 240° counterclockwise to achieve the aforementioned 60° of counterclockwise rotor rotation. Thus, if crank 15*a* rotates counterclockwise as shown in FIG. 1 two complete revolutions of crank 15*a* will result in three successive intermittent 60° rotational movements of rotor 16; whereas only one clockwise revolution of crank 15*a* is required to produce the same three 60° rotational movements of rotor 16.

If rotor 16 is the driving element, shaft 15 will tend to continue to rotate in whichever direction it began, due to its inertia and the inertia of any components attached to it. It is important to note that movements of rotor 16 are not abrupt, but that rotation of crank 15*a* will cause rotor 16 to gradually accelerate every time it begins moving and gradually decelerate every time it completes its travel. Angular velocity of rotor 16 is essentially sinusoidal compared to degrees of rotaton of shaft 15.

Further examination of FIGS. 1 and 2 will show that several additional features have been included which permit mechanism 10 to be used as a rotary fluid energy converter (RFEC). That is, liquid or gaseous fluid pressure can cause rotaion of shaft 15; or, torgue applied to shaft 15 can pump or compress fluid. A major advantage of using mechanism 10 as an RFEC is that a very large volume of fluid flow can be accommodate in a rather limited space with a relatively slow rate of shaft rotation.

The features added to mechanism 10 to convert it into an RFEC include circular thrust bearing 13*a*, disk 15*b* including its means of access of fluids to chamber 17 and the slot in rotor 16, and various seals to prevent fluid leakage. Bearing 13*a* could be replaced with a ball or roller thrust bearing to reduce friction thereat. Rotatable disk 15*b* is coaxially integral with shaft 15, provides support for crank 15*a*, and contains ports 15*c* and 15*d* for fluid passage. Opening 13*b* in end housing 13 continuously communicates through hole 15*e* with port 15*c* which is located in the left face of disk 15*b* as seen in FIG. 1, and opening 13*c* in end housing 13 continuously communicates through circular hole 15*f* with port 15*d* of disk 15*b*, thus constituting means for fluid to enter and depart chamber 17.

Sealing strips 19 at the ends of rotor 16 are held against the curved walls of triangular chamber 1 by leaf springs 19*a* so as to prevent leakage therebetween. Seals 20 and 21 prevent fluid leakage between housing 13 and shaft 15 and disk 15*b*. Seals 22 are provided to prevent fluid leakage between rotor 16 and end housings 11 and 13. FIG. 4 is a view showing the juncture between sealing strip 19 and seal 22, and revealing the approximate shape and location of leaf spring 19*a*. Lubrication means are not depicted in RFEC 10 but could be added if the fluid is an inadequate lubricant.

Note in FIG. 2 that rotor 16, chamber 17, and crank 15*a* have the same axial dimension. Thus, rotor 16 divides chamber 17 into two variable volume compartments and crank 15*a* divides the slot of rotor 16 into two variable volume cells.

In FIG. 1, if RFEC 10 is operated as a fluid motor, the direction of rotation of shaft 15 will depend upon which port is used for fluid entry. If fluid enters through opening 13*b*, passing through duct 15*e* and port 15*c*, it can be seen that rotor 16 blocks port 15*c* with respect to chamber 17 and that thus full fluid pressure in the slot cell on the left side of crank 15*a* is directed against crank 15*a*, causing it to move to the right and thus begin to rotate counterclockwise as shown by an arrow. Fluid in the slot cell on the right side of crank 15*a* is free to exit through port 15*d*, hole 15*f* and opening 13*c*. As crank 15*a* begins to move to the right, disk 15*b* begins to rotate counterclockwise and begins to expose port 15*c* to the compartment of chamber 17 below rotor 16 and begins to expose port 15*d* to the compartment of chamber 17 above rotor 16. Fluid pressure from port 15*c* under rotor 16 will then cause it to move upwards as shown by an arrow, causing fluid above rotor 16 to depart via port 15*d*.

FIG. 3 shows the position of rotor 16 after 30° of counterclockwise rotation, and crank 15*a* after 120° of counterclockwise rotation. Note that in this position ports 15*c* and 15*d* provide their maximum exposure to the compartments of chamber 17 above and below rotor 16, which is appropriate since fluid flow in and out of chamber 17 is greatest at this location. Also, ports 15*c* and 15*d* no longer communicate with the slot cells of rotor 16, this also being appropriate since crank 15*a* is not moving in the rotor slot at this location. After an additional 30° of rotor 16 rotation and further 120° rotation of crank 15*a*, rotor 16 will be adjacent the left wall of chamber 17. Then rotor 16, crank 15*a*, port 15*c* and port 15*d* will have the same relative position to the left wall of chamber 17 as they had to the bottom wall in FIG. 1. Rotor 16 is then ready to begin its next cycle, in which its upper end would be the pivot and the lower end would move towards the right into the lower right corner.

RFEC 10 may be oppositely operated as a pump or compressor. Then rotation of shaft 15 in the direction shown will cause fluid to enter via opening 13*b* and depart via opening 13*c*; opposite rotation causing opposite fluid flow. Note though that counterclockwise rotaton of shaft 15 will pump only half the volume of fluid per revolution than clockwise rotation.

Latches 18 may be omitted when mechanism 10 is operated as a fluid energy converter, because the pressure of fluid in one end of the rotor slot will cause that end of the rotor to be forced into its corner and thus act as a pivot, leaving the other end free to rotate. With latches 18 omitted, when RFEC 10 is employed as a fluid motor, shaft 15 and rotor 16 will rotate in the same direction; whereas when operated as a fluid pump or compressor, shaft 15 and rotor 16 will rotate in opposite direction.

FIGS. 5, 6, and 7 illustrate Rotary Fluid Energy Converter (RFEC) 50 which is similar to RFEC 10, except that RFEC 50 has two energy conversion sections out of phase with each other and has several other differences. Obviously more than two energy conversion sections could be connected together. In FIGS. 5, 6, ad 7, end plate 51, two identical chamber housings 52 which are inverted with respect to each other, central circular divider 53, and shaft housing 54 are stationary and held together by bolts 55 with their associated nuts and washers.

The dynamic components of RFEC 50 include two rotors 57 and shaft 56. Affixed to or integral with shaft 56 are central disk 56*a*, two cranks 56*b*, and end disk 56*c* and 56*d*. Both end disks have outer rings 56*i* press-fitted and affixed to them with retaining rings, the disks being of two-part construction to permit installation of housings 52 during assembly. Central disk 56*a* rotates adjacent to and between housings 52 and includes two ports 56*e*, both of which communicate through drilled hole 56*f* with peripheral groove 56*g*. Thus, fluid opening 53*a* is continuously in communication with both ports 56*e*, each of which faces a triangular chamber. End disks 56*c* and 56*d* each include a port 56*h* which continuously communicates through the space between it and its adjacent end housing with fluid openings 51*a* and 54*a* respectively.

The hidden lines in FIGS. 5 and 6 depict the edges of ports 56*e* and 56*h*. In FIG. 6, the short hidden line radially aligned with the center of housing 52 indicates an edge of a triangular notch cut into the side of disk 56*c* adjacent rotor 57. The purpose of this notch is to assure fluid access between port 56*h* and the slot in rotor 57, similar notches being cut in disk 56*d* and central disk 56*a*. Rotors 57 are of split construction, the identical halves being fastened to each other with screws 58. Crank shoes 59 surround cranks 56*b* and provide increased bearing and sealing surface between them and the slots in rotor 57. Seals 60 and 63 prevent fluid leakage at those locations.

Although not shown in FIG. 5, bushings or other bearings may be used to reduce friction between shaft 56 and the stationary elements it contacts. Also, central divider 53 could be provided with bearings where it acts as a journal, to radially support central rotating disk 56*a*.

In FIG. 6, recesses 61 are provided in chamber housing 52 to assure that rotors 57 can rotate only in a predetermined direction. As an end of rotor 57 enters a corner of housing 52, the spring-loaded sealing strip 62 thereat will slip into recess 61 to prevent opposite rotaton of rotor 57. The juncture of seals 60 and sealing strips 62 is similar to that in FIG. 4. If sealing strips are not used, broad rounded recesses in the chamber corners or notches across the ends of rotor 57 will serve the same purpose.

Operation of RFEC 50 is similar to that of RFEC 10, except that two fluid energy converters are operated in parallel and in opposite phase with each other; so that as one rotor is adjacent a chamber wall with zero fluid flow in the chamber thereat the other rotor is midway in its travel with maximum chamber fluid flow, resulting in a combined fluid flow which is rather steady. Fluid pressure reacts in slot cells against cranks 56*b* and within chamber compartments against rotors 57 just as in mechanism 10.

Fairly uniform fluid flow may be obtained with only one chamber and rotor by using a very broad rotor and crank, so that the combined volume of the slot cells approaches the combined volume of the chamber compartments.

If RFEC 50 is operated as a fluid motor with fluid entering opening 53*a*, fluid will enter the chambers inside housings 52 through ports 56*e* and depart through ports 56*h*, rotation being in the direction of the arrows. Opposite fluid flow will reverse the direction of rotation of rotors 57. Instead of having fluid ports 56*h* in end disks 56*c* and 56*d* as shown, all fluid ports could be located within central disk 56*a*, in which event one fluid opening would be 53*a*, the other passage being centrally through either or both cranks and then through end plates 56*c* or 56*d*, or through shaft 56.

FIG. 7 shows a cross section through central circular divider 53 and central disk 56*a* to indicate ports 56*e*, hole 56*f*, and peripheral groove 56*g*.

Cranks 56*b* are displaced in opposite directions from the shaft axis, so that shaft 56 and its integral componets may readily be dynamically balance.

FIGS. 8 and 9 depict Rotary Fluid Energy converter 80 which differs from RFEC 10 primarily in that it has a variable displacement capabilty. That is, the volume of fluid flowing through RFEC 80 during each revolution of its shaft may be varied from a small to a large amount.

Looking primarily at FIG. 8, the stationary components include left end housing 81 and right end housing 82, which are fastened to each other by three bolts 83 and associated nuts and washers. End housing 81 supports shaft 84 and additionally includes triangular chambers 96 and 97 and an assembly of sliding components. The dynamic components include shaft 84 with affixed crank 84*a* which rotates within housing 81 and is prevented from moving axially by a snap ring, central plate 85 which is inserted between housings 81 and 82 and is free to rotate and oscillate radially but not free to move axially, and an assembly of sliding components most of which additionally rotate. This sliding assembly includes triangular ring 86 which has the same cross section as chambers 96 and 97, left disk 87 with its tubular axial extension 87*a*, rotor 88, rotor bearing shoes 89, right end cover 90 which seals the right end of the slot in rotor 88 to prevent escape of fluid thereat, key 91 which keeps end cover 90 aligned with axial extension 87*a*, and snap ring 92 which fastens end cover 90 to extension 87*a*.

FIG. 9 is a cross sectonal view showing that central plate 85 is generally oval and has a transverse oval hole which is shaped as the cross section of rotor 88 so that rotor 88 can freely slide wthin it, seal 93 preventing fluid leakage therebetween. As rotor 88 intermittently rotates within the triangular portion of left end housing 81, central plate 85 slides in and out of the three lobes 81*a* housing 81. In FIG. 8, seal 94 prevents leakage of fluid between central plate 85 and housing 81.

Triangular ring 86 does not rotate but slides axially within housing 81. Ring 86 moves axially with disk 87, being held in position on it by the lip on the left edge of disk 87 and by the left side of rotor 88. Ring 86 includes two longitudinal slots 86*a*, one in each of two of its three corners. Each longitudinal slot 86*a* provides communicaton between one of the fluid openings 81*b* through an annular groove 87*b* and a duct 87*c* with one of the ports 87*d* in the side of disk 87 facing chamber 97. Thus ports 87*d* each continuously connect with a separate fluid duct 81*b*. Seals 95 prevent leakage between ring 86 and housing 81. Seals 99 prevent leakage between ring 86 and disk 87.

A cross section through chamber 97 looking to the left would show a relationship between rotor 88, ring 86, disk 87, crank 84*a* and ports 87*d* similar to that of comparable components in FIG. 1.

When RFEC 80 is operated as a fluid motor, fluid under pressure enters it through a duct 81*b*, passing through an annular groove 87*b* and a port 87*d* before entering chamber 97, where it reacts upon rotor 88 to cause rotaion of shaft 84, just as in RFEC 10. Spent fluid departs via the other port 87*d*, groove 87*b* and duct 81*b*. Fluid flow in the opposite direction will cause shaft 84 to rotate in the opposite direction.

When RFEC 80 is employed as a fluid pump, rotaton of shaft 84 causes rotor 88 to permit fluid to enter chamber 97 through one of the ports 87*d* and to force fluid out of the other port 87*d*.

Whether RFEC 80 is operated as a pump or a motor, the combined surface area of the left end of ring 86 and disk 87 is greater than that portion of their right ends subjected to fluid pressure. So, if control chamber 96 is subjected to supply fluid pressure through duct 81*c*, the sliding assembly is forced to the right and the displacement of chamber 97 decreases. Conversely, if fluid is permitted to escape control chamber 96, fluid pressure in chamber 97 forces the sliding assembly to the left and the displacement of chamber 97 increases. Blocking duct 81*c* will cause the displacement of chamber 97 to remain constant. Chamber 98 is circular and is vented through opening 82*a*.

Control of RFEC 80 as either a fluid pump or motor may be accomplished by use of a three-way valve, such as a spool valve, the port adjacent the center of such valve being connected to duct 81*c* and normally being closed. Moving the spool in one direction would connect duct 81*c* to the fluid reservoir thereby permitting fluid to drain from chamber 96 and the displacement of chamber 97 to increase. Moving the spool in the opposite direction would permit fluid under pressure to enter chamber 96, resulting in a decrease in chamber 97 displacement. Conventional means of providing constant speed, constant flow rate or constant pressure may be readily adapted to RFEC 80. Mechanical or electromagnetic means could also be used to vary displacement.

Although latches or recesses are not included in RFEC 80 to positively assure only one direction of rotation of rotor 88, such means may readily be added if desired. Also, axially oriented springs in chambers 96 or 98 could be used to aid in changing the displacement of chamber 97.

Figure 10:
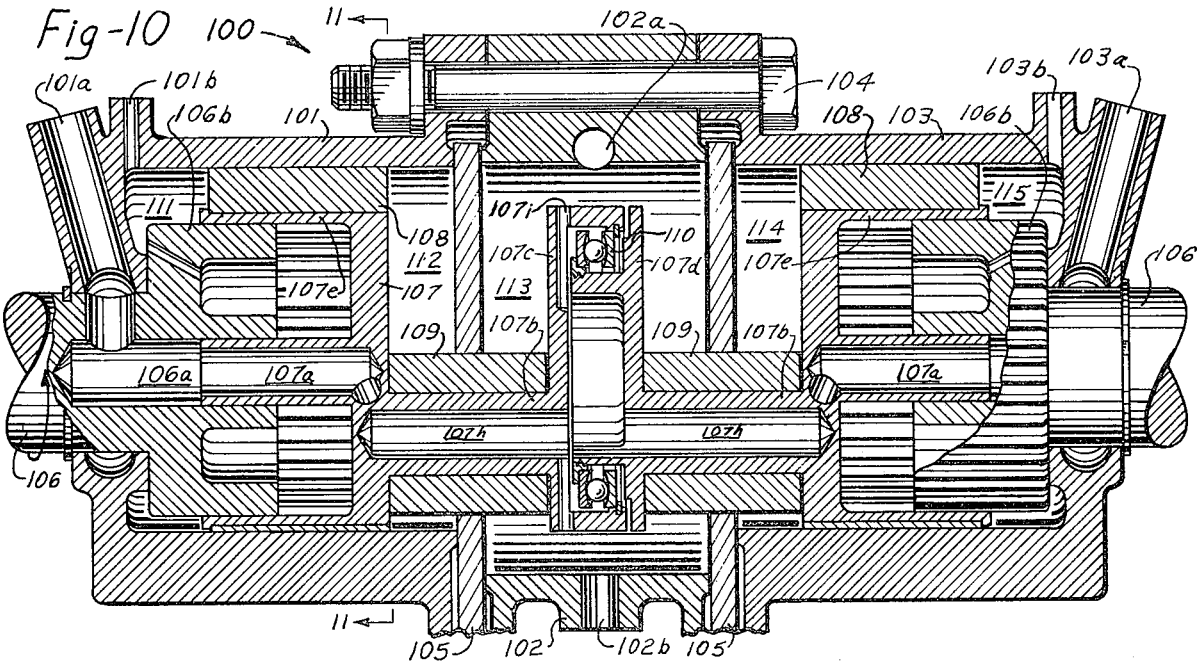
FIG. 10 is a vertical sectional view of another rotary fluid energy converter which provides continuously variable speed ratios between two rotating shafts, in accordance with another embodiment of the invention.
Figure 11:
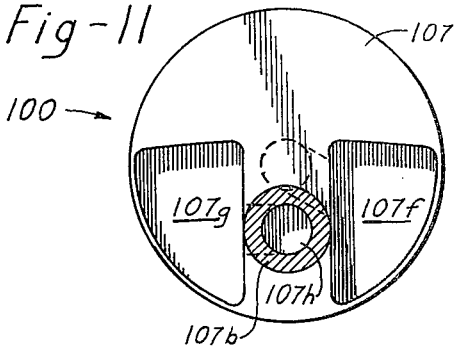
FIG. 11 is a partial sectional view taken along line 11—11 of FIG. 10 and looking to the left, to reveal details of internal fluid routing.

FIGS. 10 and 11 depict Rotary Fluid Energy Converter 100, in which two RFEC 80's are connected back to back, their sliding assemblies being connected through a thrust bearing which permits them to rotate independently but requires them to move together axially. Rotation of the shaft on one end of RFEC 100 causes fluid to be pumped from the variable displacement chamber in one end into an inversely variable displacement fluid motor chamber in the other end, thus providing a positive displacement fluid coupling between two shafts in which continuously variable high or low speed ratios may be obtained. Additionally in RFEC 100, other means are used to connect the sliding assemblies to their respective shafts, and other fluid routing means are employed.

In FIG. 10 may be seen three stationary housings 101, 102 and 103 which are joined together by bolts 104 with their associated nuts and washers. Two rotating and oscillating disks 105 are shaped and operate as disk 85 of FIG. 8. In FIG. 10, end housings 101 and 103 each have a shaft 106 installed and held in position by a snap ring. Each shaft 106 has a hollow central duct 106*a* which communicates with fluid opening 101*a* or 103*a*. Ducts 106*a* each have a tube 107*a* sliding axially within them. Each shaft 106 also has an integral externally splined cup-shaped portion 106*b* which engages internal splines on cup-shaped portion 107*e* of adjacent disk 107. Thus shaft 106 and disk 107 must rotate together but disk 107 may slide axially.

The left sliding assembly of RFEC 100 is comprised of disk 107, triangular ring 108, crank 107*b*, cover 107*c*, and rotor 109 which of split construction. The right sliding assembly is identical except that cover 107*d* differs from cover 107*c* to permit axial load thrust bearing 110 to be installed between them. Very little axial clearance is necessary between covers 107*c* and 107*d* because they tend to move apart during operation, as will be shown later. Fluid seals, wiper blades latches and crank shoes similar to those of the preceding RFEC's may be added if desired.

A cross sectional view through chamber 112 and looking to the left would be very similar to FIG. 1, as would a cross sectional view through chamber 114 looking to the right.

In FIGS. 10 and 11, rotation of left shaft 106 in the direction shown causes fluid to enter port 101*a* of RFEC 100 and pass through central duct 106*a*, tube 107*a*, and port 107*f* into the adjacent rotor slot and into chamber 112. Fluid is pumped from chamber 112 through port 107*g* and duct 107*h* inside left crank 107*b*, from whence it may either enter duct 107*h* inside the right crank 107*b* to actuate the right sliding assembly as a fluid motor, or pass into central chamber 133 through holes 107*i*. Gas trapped in central chamber 113 causes it to operate as an accumulator, so as to even out the fluid pulses caused by fluid flow from chamber 113 repeatedly varying from minimum to maximum. Similarly the fluid flow through the right sliding section causes it to act as a fluid motor, the flow there also varying from minimum to maximum. The inertia of the components attached to right shaft 106 cause it to tend to rotate at a constant angular velocity, as does the damping action of compressed gas trapped in central chamber 113. If additional damping or isolated damping is desired an accumulator may be connected to duct 102*a;* duct 102*a* otherwise being deleted.

RFEC 100 may be operated as a closed system in which fluid departing duct 103*a* enters a reservoir, from which it is drawn back into duct 101*a*.

During operation, the fluid pressure inside the pumping portion of chamber 112, all of chamber 113, and the fluid motor portion of chamber 114 will tend to be the same because these are almost continually in communication with each other through the intervening ducts and ports. However, the axial forces exerted by these fluids will vary considerably depending upon the amount of side area of rings 108 and disks 107 upon which they happen to be acting at any given instant. To prevent this force variation from causing axial oscillation of the sliding assembly, control chambers 111 and 115 should be kept full of liquid, and valves to ducts 101*b* and 103*b* should be kept closed except when changing displacement. As discussed with RFEC 80, fluid pressure in the variable displacement chambers will cause them to tend to move towards their shaft ends and thus away from the center of RFEC 100, there thus being continual tension between disks 107*c* and 107*d*.

To change the speed ratio between the two shafts 106, a spool valve similar to that previously described may be employed to admit fluid under pressure from duct 102*b* to either duct 101*b* or 103*b*, fluid from the other duct 102*b* being simultaneously permitted to drain into the aforementioned reservoir. Thus, if the left shaft is the driving unit and if the sliding assemblies are caused to move to the right, then displacement in chamber 112 will decrease while displacement in chamber 114 wll increase; both displacement changes causing the right shaft 106 to slow down. Conversely, moving the sliding assemblies to the left will increase the pumping activity of the left sliding assembly and decrease the space available in chamber 114 for fluid motor action, causing the speed of the right shaft 106 to increase. When the sliding assemblies are all the way to the right, only fluid in the left rotor slot is pumped and right shaft 106 rotates at its minimum speed. With the sliding assemblies all the way left, only the space inside the right rotor slot is available for motor action and right shaft 106 will rotate at its maximum speed.

Figure 13:
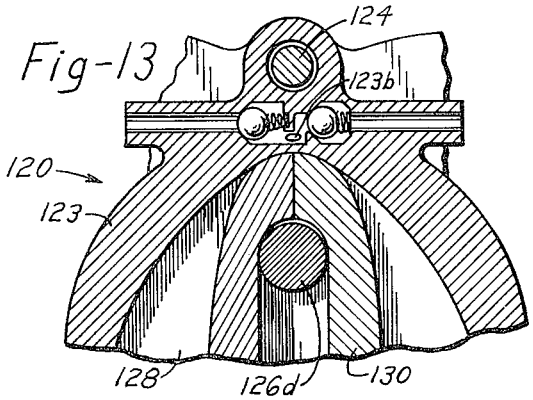
FIG. 13 is a partial sectional view taken along line 13—13 of FIG. 12 and looking to the left to depict a different valve arrangement.
Figure 12:
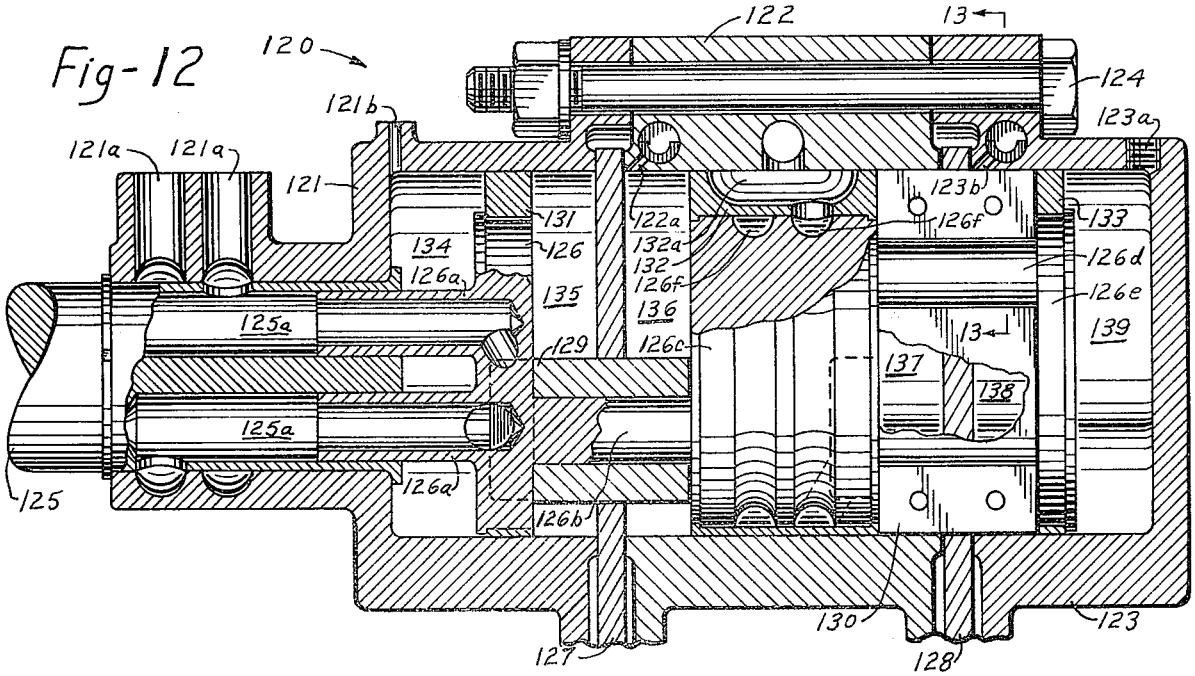
FIG. 12 is a vertical sectional view of a multiple section variable displacement rotary fluid energy converter in accordance with another embodiment of the invention.

FIGS. 12 and 13 illustrate Rotary Fluid Energy Converter 120, which is a positive and variable displacement device usable either as a fluid pump or motor, or for other purposes as will be discussed later. It is similar to RFEC 80, but has two variable displacement rotors instead of one, may have as many as four variable displacement chambers, has a different connection between the sliding assembly and the drive shaft, ans has different means of routing fluid to and from the variable displacement chambers.

Looking now primarily at FIG. 12, there wll be seen three stationary housings 121, 122 and 123, the three being held together by bolts 124 and their associated nuts and washers. Stub drive shaft 125 is mounted in left housing 121 and affixed to it by a snap ring so that it may freely rotate but not slide axially; bearings being addible thereat if desired. Shaft 125 has two holes 125*a* in its right end, each communicating with a hole 121*a* in housing 121. Tubes 126*a* of left disk 126 slide in holes 125*a* of stub shaft 125, therewith providing a means of causing these two components to rotate together. Each tube 126*a* addtionally provides a route of fluid access from one of the ducts 121*a* to one of the ports on the right face of left disk 126, these two ports being shaped and used similarly to those of RFEC 10. A cross section through chamber 135 and looking to the left would be very similar to FIG. 1.

Two oval plates 127 and 128 similar in shape and action to plate 85 of FIG. 9 are provided. In FIG. 12, plates 127 and 128 rotate and oscillate within lobes at the junctures of housing 121 with 122 and housing 122 with 123 and, each has an elongate hole in which rotors 129 and 130 slide.

The sliding assembly of RFEC 120 includes left disk 126 with its affixed or integral tubes 126*a*, left crank 126*b*, central disk 126*c*, right crank 126*d*, right disk 126*e*, rotors 129 and 130, sliding triangular rings 131, 132 and 133. Ring 131 is prevented from moving to the left by a lip on the left edge of disk 126 and is kept from moving to the right by rotor 129. Ring 133 is similarly held in position with respect to disk 126*e*. Central ring 132 has lips on both sides and is split so that it can be slipped over central disk 126*c*, the split being located at one of the three corners and fastened with one or more screws. These two lips may be omitted because rotors 129 nd 130 would keep ring 132 in position. Central ring 132 has longitudinal slots 132*a* in the other two of its three corners which function similar to slots 86*a* of FIG. 8. In FIG. 12, each slot 132*a* communicates through a hole with an annular groove 126*f* on the outer periphery of central disk 126*c*, these annular grooves each connecting through one or more internal holes with a port in the right face of central disk 126*c*. A view of the right face of central disk 126*c* looking from right to left would be very similar to FIG. 6, except that disk 126*c* has two ports instead of only one. The left face of central disk 126*c* and of right disk 126*e* serve as rotor end covers and have no ports.

Rotors 129 and 130 are of split construction as in RFEC 50, having internal slots to accommodate the motion of cranks 126*b* and 126*d* respectively. Rotors 129 and 130 operate in variable displacement chambers of RFEC 120 in the same manner as rotor 88 of RFEC 80, the primary difference being that RFEC 120 has two variable displacement sections instead of just one. RFEC 120 differs further in that fluid is caused to enter and depart both end chambers 134 and 139 to vay the displacement, whereas in RFEC 80 only the left end chamber 96 is used for this purpose. In FIG. 12, there are normally four variable displacement chambers 135, 136, 137, and 138. Of these, chambers 135 and 137 work with each other in opposite phase so as to assure a uniform flow of fluid through them. Chambers 135 and 137 may be used either as a pump or a fluid motor. Seals and latches may be added if desired.

Chambers 136 and 138 may each include a bypass around the portion of rotors 129 and 130 which is inside them, such as a groove in the internal periphery of their adjacent housings, or may be otherwise caused to bypass fluid around their ends so as to make them inactive. Or, chambers 136 and 138 may be used to provide useful pumping action. But since the internal slots of rotors 129 and 130 contain fluid acting in conjunction with chambers 135 and 137, other means must be provided for accommodating fluid flow to and from chambers 136 and 138 if they are to act as pumps, except when the same fluid source is used. One other means of providing such fluid flow is by providing a dual check valve assembly, such as that shown in FIG. 13, in each of the three corners of each chamber 136 and 138, access thereto being through ducts 122*a* and 123*b* adjacent disks 127 and 128 respectively. Chambers 136 and 138 will operate in opposite phase, just as chambers 135 and 137.

With chambers 135 and 137 working together and 136 and 138 working together, these four chambers can convert energy in several ways. When torque is applied to shaft 125, both pairs of chambers may act as pumps, drawing fluid from the same source and delivering it in inversely variable amounts to different destinations; or two independent fluid systems may be had. Or, chambers 135 and 137 may be used as a fluid motor and chambers 136 and 138 as a fluid pump, resulting in a fluid-to-fluid energy transformer which can deliver fluid pressure and flow continuously variable over a broad range, and being comparable to the current-voltage relationship between the primary and secondary windings of an electrical transformer. In this latter use, shaft 125 would be superfluous; but in other applications it could be retained for adding mechanical energy to or withdrawing it from RFEC 120.

Practical uses for RFEC 120 as a fluid energy transformer include: remote variable-flow operation of liquid or pneumatic motors; hydraulically operated aircraft flight controls which may move rapidly under light loads and slowly under heavy loads; conversion of the energy of solar heated fluids into rotary energy while simultaneously pumping cooled fluid back to the solar heater.

Either chamber set 135 and 137 or 136 and 138 may be used as a continuously variable displacement pump which could act as a gearless automotive automatic transmission by receiving rotary mechanical energy through shaft 145 and delivering a variable flow of fluid to motors such as those of RFEC 50 at two or more wheels to drive them in rotation.

Because of the large volume of fluid that can be moved through any of the RFEC's at relatively low shaft speeds they are particularly suited for use as a steam engine, external combustion engine, or other device intended to convert gas pressure energy into torque. If variable displacement RFEC's are used for this purpose, they can be automatically adjusted to operate at the highest permissible chamber pressure under a wide range of loads, and thus provide increased efficiency.

In RFEC 120, chambers 136 and 138 could act as a supercharger to compress air which would be burned with hydrogen or other fuel and then expanded through chambers 135 and 137, to provide useful torque at shaft 125. The variable displacement feature might not be necessary in this latter use, four fixed-displacement chambers sufficing.

Internal combustion engine variations of many of the herein described RFEC's may be obtained by adapting conventional valving and ignition systems thereto.

I claim:

1. A rotary fluid energy converter comprising:

at least one chamber, said chamber being generally triangular and including three rounded corners and three interposed arcuate sides, at least one rotor, said rotor being elongate and including a longitudinally oriented slot, said rotor being rotatable end over end within said chamber and dividing it into two compartments, a rotatable shaft with crank, said crank extending into said rotor slot and dividing it into two cells, at least one disk, said disk being affixed to said crank axially adjacent said rotor, a fluid inlet port and a fluid outlet port, each said port comprising an opening in the face of said disk and communicating with an opening in said rotary fluid energy converter, each said port being shaped and oriented so that it is blocked by said rotor from both said chamber compartments and in communication with one of said slot cells when both ends of said rotor are in corners of said chamber, so that each said port is blocked from both said slot cells and in communication with one of said chamber compartments when one of said rotor ends is located adjacent the midpoint of one of said chamber walls, and so that each said port communicates with one said chamber compartment and one said rotor slot cell at all other positions of said rotor, so as to occasion energy conversion between torque of said crank acting on said rotor and fluid pressure in said chamber compartments and said slot cells.

2. The rotary fluid energy converter claimed in claim 1 in which a fluid actuated motor is described.

3. The rotary fluid energy converter claimed in claim 1 in which a fluid pump is described.

4. The rotary fluid energy converter as claimed in claim 1 in which fluid pressure in one of said slot cells acting against the adjacent end of said rotor causes same to be held in a corner of said chamber, so as to prevent reverse rotation of said rotor.

5. A rotating mechanism comprising:

a rotatable shaft, said shaft including a crank at one of its ends, a stationary housing containing said rotatable shaft, a chamber housing, the inner periphery of said chamber housing describing a chamber which is generally triangular in cross-section, said chamber including three corners and three interposed arcuate sides, said chamber housing being coaxially affixed to said stationary housing and surrounding said crank, a rotor, said rotor being elongate and including an elongate slot, said rotor being located within said chamber with said crank extending into said slot, said rotor being free to rotate end over end within said chamber, said ends of said rotor remaining in contact with said corners and said sides of said chamber, latching means for preventing reverse movement of said rotor upon arrival of its ends in said corners of said chamber, so as to provide intermittent rotation of said rotor in a predetermined direction in conjunction with continuous rotation of said shaft.

6. The rotating mechanism as claimed in claim 5 in which said latching means includes latches in said corners of said chamber and recesses at said ends of said rotor.

7. The rotating mechanism as claimed in claim 5 in which notches are provided in said corners of said chamber and latches are provided in the ends of said rotor, said latches engaging said notches when ends of said rotor enter corners of said chamber.

8. The rotating mechanism as claimed in claim 7 in which said latches are strips which extend across said ends of said rotor.

* * * * *